US007591928B2

(12) United States Patent
Billings et al.

(10) Patent No.: US 7,591,928 B2
(45) Date of Patent: Sep. 22, 2009

(54) SPIRAL LINK FABRIC AND METHODS TO BUILD THE SAME

(75) Inventors: Alan L. Billings, Clifton Park, NY (US); Curtis L. Gardner, Colonie, NY (US)

(73) Assignee: Albany International Corp., Albany, NY (US)

( * ) Notice: Subject to any disclaimer, the term of this patent is extended or adjusted under 35 U.S.C. 154(b) by 293 days.

(21) Appl. No.: 11/513,961

(22) Filed: Aug. 31, 2006

(65) Prior Publication Data

US 2007/0144698 A1 Jun. 28, 2007

Related U.S. Application Data

(60) Provisional application No. 60/713,095, filed on Aug. 31, 2005.

(51) Int. Cl.

| | |
|---|---|
| ***D21F 1/10*** | (2006.01) |
| ***D21F 7/08*** | (2006.01) |
| ***D21F 7/12*** | (2006.01) |
| ***B21F 27/18*** | (2006.01) |

(52) U.S. Cl. ..... 162/348; 162/358.2; 162/900; 162/903; 245/4; 428/222

(58) Field of Classification Search ..... 162/348, 162/358.2, 900, 902–904, 116; 198/848; 428/222; 245/6, 2, 4, 5, 9; 139/383 AA; 140/3 R, 111

See application file for complete search history.

(56) References Cited

U.S. PATENT DOCUMENTS

| | | | | |
|---|---|---|---|---|
| 1,246,893 | A * | 11/1917 | Doppenschmitt | 245/9 |
| 1,784,254 | A * | 12/1930 | Schofer | 140/3 B |
| 4,567,077 | A | 1/1986 | Gauthier | |
| 4,575,472 | A | 3/1986 | Lefferts | |
| 4,606,792 | A * | 8/1986 | Bachmann et al. | 162/232 |
| 5,183,442 | A | 2/1993 | Lefferts | |
| 5,217,577 | A * | 6/1993 | Steiner | 162/232 |
| 5,255,419 | A * | 10/1993 | Stanislaw et al. | 26/89 |
| 5,511,241 | A * | 4/1996 | Ziegler | 2/2.5 |
| 5,829,578 | A * | 11/1998 | Froderberg | 198/848 |
| 5,915,422 | A * | 6/1999 | Fagerholm | 139/383 AA |
| 2006/0005936 | A1 | 1/2006 | Breuer et al. | |
| 2006/0124268 | A1 * | 6/2006 | Billings | 162/348 |

FOREIGN PATENT DOCUMENTS

| | | | |
|---|---|---|---|
| EP | 0 036 972 | * | 10/1981 |
| EP | 0 116 894 | A | 8/1984 |
| EP | 0 490 334 | A | 6/1992 |

OTHER PUBLICATIONS

EP 0 036 972, Oct. 7, 1981; English language machine translation.*

* cited by examiner

*Primary Examiner*—Eric Hug
(74) *Attorney, Agent, or Firm*—Frommer Lawrence & Haug LLP; Ronald R. Santucci

(57) ABSTRACT

A spiral-link fabric comprised of connected sets of "chain mail" intertwined spiral coils. Alternating sets of two right-turn spiral coils and two left-turn spiral coils are repeatedly connected to form the body of the fabric. Within each set, the spiral coil loops are intertwined in a pattern which does not require fastening to connect the coils. The alternating sets are connected by interdigitating respective spiral coil loops and inserting a series of parallel pintles extending through the channels formed by the interdigitated loops.

15 Claims, 3 Drawing Sheets

SPIRAL LINK FABRIC AND METHODS TO BUILD THE SAME

CROSS-REFERENCE TO RELATED APPLICATIONS

This application claims priority benefits of U.S. Provisional Patent Application Ser. No. 60/713,095 filed Aug. 31, 2005 entitled "Improved Spiral Fabric and Methods to Build the Same", the disclosure of which is incorporated herein by reference.

BACKGROUND OF THE INVENTION

1. Field of the Invention

The present invention relates to spiral-link fabrics. More specifically, the present invention relates to spiral-link fabrics having "chain mail" intertwined coils for use on a papermaking machine and other industrial machines requiring fabrics/belts.

2. Description of the Related Art

While the use of this fabric will be described for the papermaking process, other industrial uses exist; such as belts/fabrics for DNT (double nip thickener) machines, sludge dewatering presses, bowling pin spotter belts, and in the production of certain nonwoven products by processes such as, but not limited to, hydroentangling (spunlace), spunbonding, or air laying.

During the papermaking process, a cellulosic fibrous web is formed by depositing a fibrous slurry, that is, an aqueous dispersion of cellulose fibers, onto a moving forming fabric in a forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. Installation typically involves pulling the fabric body onto the machine and joining the ends of the fabric along a seam; thereby forming the fabric into an endless belt. It is important for the seam to exhibit operating characteristics similar to the rest of the fabric body in order to minimize periodic marking of the manufactured paper product.

A fabric may be formed completely of spiral coils (so called "spiral-link fabric") as taught by Gauthier, U.S. Pat. No. 4,567,077; which is incorporated herein by reference. In such a fabric, spiral coils are connected to each other by at least one connecting pin, pintle or the like. In theory, the seam can therefore be at any location in the fabric body where a connecting pin may be removed.

Spiral-link fabrics offer a number of advantages over traditional fabrics. For example, the seam of a spiral-link fabric is geometrically similar to the rest of the fabric body, and is therefore less likely to mark the paper product being manufactured.

Unfortunately, the production of spiral-link fabrics is both labor-intensive and expensive. This is because spiral-link fabrics are constructed of many small spiral elements that must be coiled and assembled. The multiple manufacturing steps of coiling, interdigitating, and interconnecting the spiral coils make this process costly. Because each coil is of a relatively narrow width, a great many connections are needed to form a complete fabric. Each spiral coil is connected to the next by inserting a pin, pintle or the like through the small channel formed by the interdigitated coils. The resulting large number of pintles make the fabric diagonally stiff. In addition, the shape of the coil loops results in such close spacing when interdigitated (i.e. almost touching) that the pintles are almost entirely covered.

As a result of this diagonal stiffness and the 'touching' of adjacent linked coils at each pin, conventional spiral-link fabrics are extremely stable.

However, this stiffness can be detrimental if, for example, any of the support rolls or dryer cans in a dryer section are not all parallel to one another. This lack of diagonal 'give' can then cause the spiral-link fabric to edge-up and/or to guide poorly, eventually damaging the edges of the fabric as it contacts guards, frames, etc. . . . and eventually leading to premature replacement.

FIG. 5 is a diagram of a conventional interconnection between a right-turn spiral coil 501 and a left-turn spiral coil 502 for a prior art spiral-link 25 fabric. A pintle 503 is inserted between the interdigitated loops of the right and left turn spiral coils. Note the close spacing of the interdigitated loops which effectively covers the pintle. For clarity, the foreground portions of the coils are shown as solid lines while the background portions of the loops are shown as dashed lines.

The present invention overcomes these shortcomings by providing a spiral-link fabric which is more flexible, especially across the diagonal, and has improved spacing between the interdigitated coils (especially over the pintles).

SUMMARY OF THE INVENTION

Accordingly, the present invention relates to a spiral-link fabric having "chain mail" intertwined coils for use in a papermaking machine.

The present invention is a spiral-link fabric comprised of connected sets of "chain mail" intertwined spiral coils. In a preferred embodiment, alternating sets of two right-turn spiral coils and two left-turn spiral coils are repeatedly connected to form the body of the spiral-link fabric. Within each set, the spiral coil loops are intertwined in a "chain mail" pattern which does not require fastening to connect the coils. The alternating sets are connected by interdigitating respective spiral coil loops and inserting a series of parallel pintles extending through the channels formed by the interdigitated loops. Other embodiments include differing numbers of coils in each set and various combinations of sets.

Another aspect of the present invention involves spacing the loops of the spiral coils. The coil loops may be spaced on the pintle by mechanically spreading or tentering the loops during finishing (i.e. heat setting), inserting spacers on the pintle between the loops, and/or varying the diameter of the pintle.

The present invention will now be described in more complete detail with reference being made to the figures wherein like reference numerals denote like elements and parts, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

A preferred embodiment of the present invention will be described in the context of a spiral-link fabric for use in a papermachine, as well as in other industrial settings.

Figure 1:
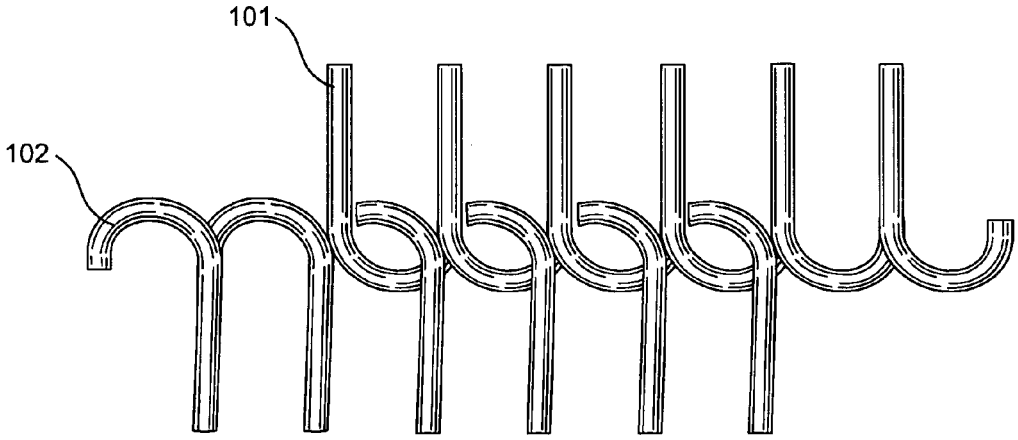
FIG. 1 is a diagram showing the "chain mail" intertwining of two right-turn spiral coils in accordance with the teachings of the present invention.
Figure 5:
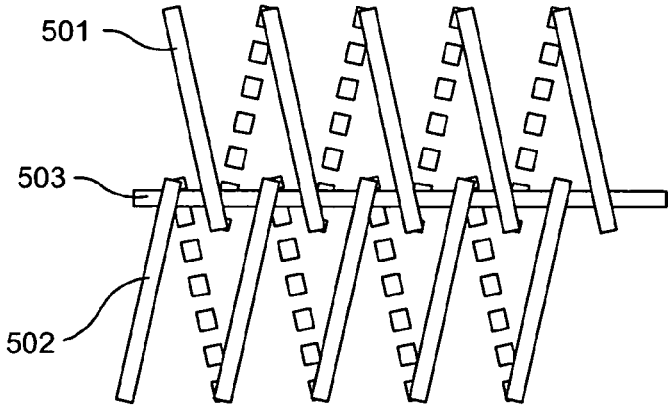
F I G. 5 PRIOR ART
FIG. 5 is a diagram of a conventional interconnection between a right-turn spiral coil and a left-turn spiral coil for a prior art spiral-link fabric.

FIG. 1 is a diagram showing the "chain mail" intertwining of two right-turn spiral coils in accordance with the teachings of the present invention. The term "chain mail" refers to the intertwined loop pattern which is similar to that found in armor. The top right-turn coil 101 is intertwined with the bottom right-turn coil 102. Importantly, the loops of the two spiral coils may be in an almost parallel alignment; as opposed to the distinct angle formed by the prior art coils (see FIG. 5). Note the intertwined loops in this "chain mail" pattern do not require a pintle to connect the coils although one could be inserted if so desired.

Figure 2:
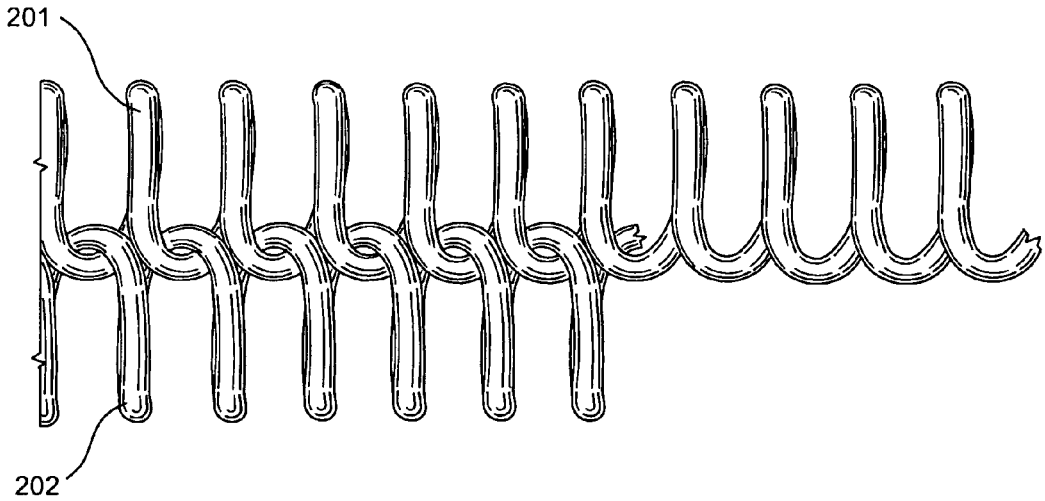
FIG. 2 is a picture of the "chain mail" intertwining of two right-turn spiral coils in accordance with the teachings of the present invention.

FIG. 2 is a picture of the "chain mail" intertwining of two right-turn spiral coils in accordance with the teachings of the present invention. As in FIG. 1, the top right-turn coil 201 is intertwined with the bottom right-turn coil 202; thereby connecting the two coils in the "chain mail" pattern.

Figure 3:
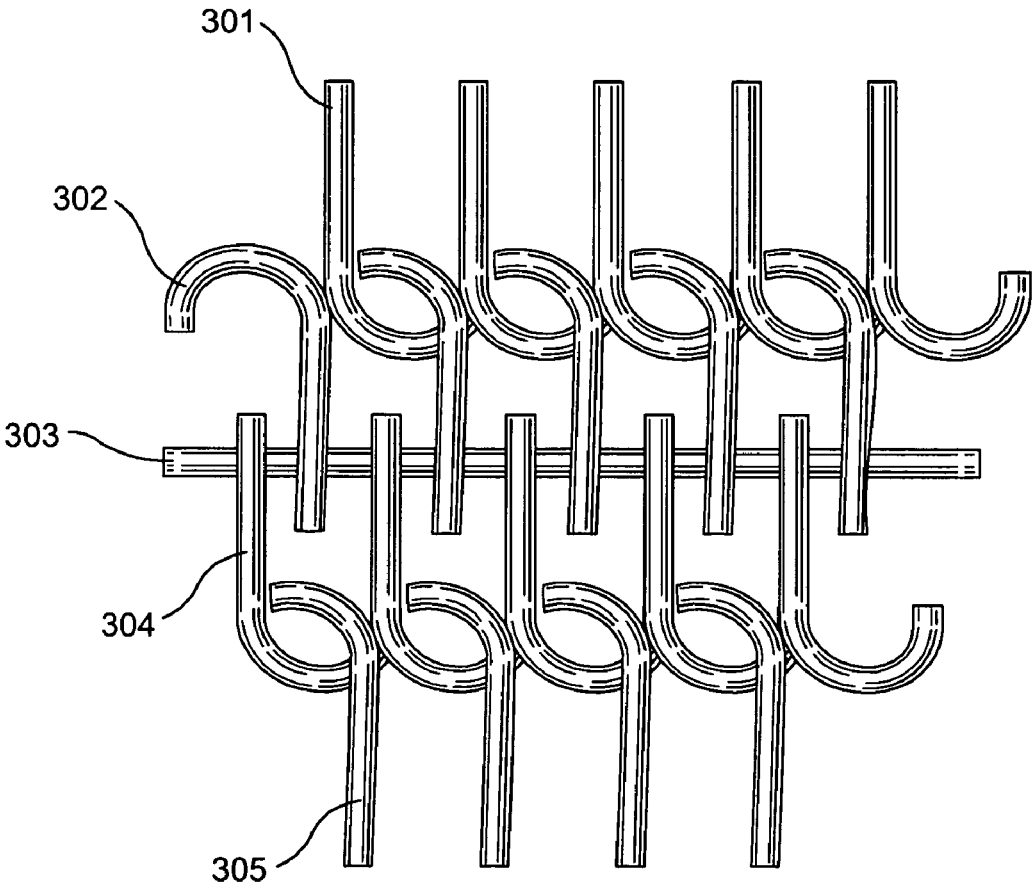
FIG. 3 is a diagram of an interconnection between a set of two right-turn spiral coils and a set of two left-turn spiral coils in accordance with the teachings of the present invention.

FIG. 3 is a diagram of an interconnection between a set of two right-turn spiral coils and a set of two left-turn spiral coils in accordance with the teachings of the present invention. In the set of two right-turn spiral coils (which is similar to that shown in FIG. 1), the top right-turn coil 301 is intertwined with the bottom right-turn coil 302. Likewise, in the set of two left-turn spiral coils, the top left-turn coil 304 is "chain mail" intertwined with the bottom left-turn coil 305. The sets are connected by interdigitating the loops of the bottom right-turn coil 302 in the top set and the top left-tuni coil 304 in the bottom set and passing a pintle 303 through the passage formed therebetween. Alternating sets of two right-turn spiral coils and two left-turn spiral coils connected by a pintle may be repeatedly connected in this manner to form the body of the spiral-link fabric. This use of alternating sets of two right and two left coils is a preferred embodiment of the present invention and again do not require a pintle although pintles can be used if so desired. However, the present invention is not limited as such and various combinations of sets with differing numbers of coils in each may be used.

Figure 4:
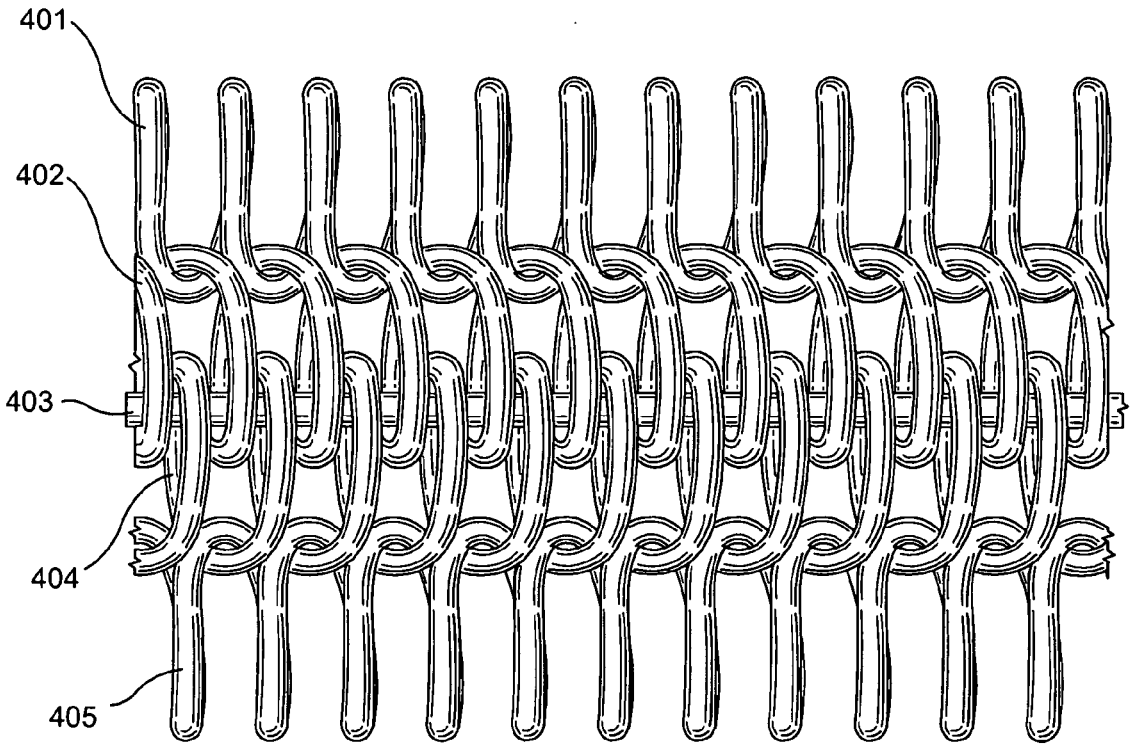
FIG. 4 is a picture of an interconnection between a set of two right-turn spiral coils and a set of two left-turn spiral coils in accordance with the teachings of the present invention.

FIG. 4 is a picture of an interconnection between a set of two right turn spiral coils and a set of two left turn spiral coils in accordance with the teachings of the present invention. As discussed in relation to FIG. 3, the sets are connected by interdigitating the loops of the bottom right-turn coil 402 in the top set and the top left-turn coil 404 in the bottom set and passing a pintle 403 through the passage formed therebetween. Because the interdigitated loops are nearly parallel for these types of coils, distinct spaces exist between the loops. As shown, more of the pintle is exposed as a result of these spacings. The spacing on the pintles and the "chain mail" connection result in more flexibility of the fabric. Importantly, this approach of using sets of "chain mail" intertwined spiral coils reduces the number of pintles by at least a factor of two over a typical spiral-link fabric. By reducing the number of pintles, the resulting fabric is even more flexible; especially diagonally.

Advantages of the present invention over prior art spiral-link fabrics include a reduction in the required number of pintles, increased flexibility (especially, improved diagonal 'give'), and easier pintle insertion. Further, the resulting fabrics may have a reduced weight per unit area, thereby offering a material cost advantage.

Another aspect of the present invention involves spacing the loops of the spiral coils. The coil loops may be spaced on the pintle by mechanically spreading or tentering the loops during finishing (i.e. heat setting), inserting spacers on the pintle between the loops, and/or varying the diameter of the pintle in the CD direction. For example, the shape of the coils may be modified to include a "leg" or spacing section, similar to that taught in Fagerholm, U.S. Pat. No. 5,915,422; the disclosure of which is incorporated herein by reference. This technique results in the formation of fairly straight coil loops which further increase the spacing on the pintles, resulting in even more flexibility out of both the "chain mail" connection and the pintle connection of the fabric. Several additional techniques are disclosed in commonly assigned U.S. patent application Ser. No. 11/012,512, filed Dec. 15, 2004 and U.S. patent application Ser. No. 11/009,157, filed Dec. 10, 2004; the disclosure of which are incorporated herein by reference.

Further, the present invention encompasses a method for manufacturing "chain mail" intertwined spiral coils as disclosed herein. Current methods for manufacturing spiral coils involve winding and setting a single monofilament on a horizontal or vertical mandrel. In the present method, two side-by-side monofilaments are introduced to the coiling machine and to the winding head on the mandrel; thereby producing an intertwined "chain mail" pair of coils.

The spiral coils may be formed of a polymer (such as polyester), metal or other material suitable for this purpose and known to those skilled in the art. As is appreciated, the spiral coils may be formed in other shapes, for example, round or non-round such as rectangular, oval, flattened or any other shape suitable for the purpose. Further, the spiral coils may be formed from a monofilament or multifilament material, which may take a number of cross sectional shapes such as round or non-round such as rectangular, oval, flattened, star shaped, grooved or any other cross section suitable for the purpose. Wider spiral coils may also be used, as taught in incorporated U.S. patent application Ser. No. 11/012,512, filed Dec. 15, 2004. Note these examples are simply representative examples of the invention and are not meant to limit the invention. As with any spiral-link fabric, some applications may require modifying certain fabric characteristics, such as controlling the air permeability. This can be accomplished, for example, by varying the size of the spiral links; by coating and/or impregnating with polymeric resins; and/or by using any number of types of stuffer yarns.

Modifications to the above would be obvious to those of ordinary skill in the art, but would not bring the invention so modified beyond the scope of the present invention. The claims to follow should be construed to cover such situations.

What is claimed is:

1. A spiral-link fabric with improved flexibility for use in a papermaking machine, comprising:

a plurality of right-turn sets of right-turn spiral coils intertwined in a "chain mail" pattern; wherein the "chain mail" pattern does not require fastening to connect the coils and spiral coil loops of the spiral coils are substantially parallel;

a plurality of left-turn sets of left-turn spiral coils intertwined in said "chain mail" pattern;

wherein alternating right-turn sets and left-turn sets are connected by interdigitating respective spiral coil loops and inserting a series of parallel pintles extending through the channels formed by the interdigitated loops.

2. The spiral-link fabric of claim 1, wherein the interdigitated loops of the alternating right-turn and left-turn sets are spaced on the pintles by mechanically spreading the spiral coil loops during finishing.

3. The spiral-link fabric of claim 1, wherein the interdigitated loops of the alternating right-turn and left-turn sets are spaced on the pintles by tentering the spiral coil loops during finishing.

4. The spiral-link fabric of claim 1, wherein the interdigitated loops of the alternating right-turn and left-turn sets are spaced on the pintles by inserting spacers on the pintle between the loops.

5. The spiral-link fabric of claim 1, wherein the interdigitated loops of the alternating right-turn and left-turn sets are spaced on the pintles by varying the diameter on each of the pintles in the CD direction.

6. The spiral-link fabric of claim 1, wherein distinct spaces, exposing portions of the pintles, exist between the interdigitated loops because the interdigitated loops are substantially parallel.

7. The spiral link fabric of claim 1, wherein the spiral coils are round, non-round, rectangular, oval, or flattened.

8. The spiral link fabric of claim 7, wherein the spiral coils are formed from monofilaments or multifilaments.

9. The spiral link fabric of claim 1, wherein the spiral coils are formed of a polymer or metal.

10. The spiral-link fabric of claim 8, wherein the monofilaments or multifilaments have a cross section which is round, non-round, rectangular oval, flattened, star shaped or grooved.

11. The spiral-link fabric of claim 1, wherein the right-turn sets are comprised of two right-turn spiral coils and the left-turn sets are comprised of two left-turn spiral coils.

12. The spiral-link fabric of claim 1, wherein the right-turn sets are comprised of one right-turn spiral coil and the left-turn sets are comprised of one left-turn spiral coil.

13. The spiral-link fabric of claim 1, wherein the right-turn sets are comprised of more than two right-turn spiral coils and the left-turn sets are comprised of more than two left-turn spiral coils.

14. The spiral link fabric of claim 1, wherein the spiral coils are formed of straight coil loops parallel to each other.

15. The spiral link fabric of claim 1, which includes additional pintles inserted in the "chain mail" pattern.

* * * * *

UNITED STATES PATENT AND TRADEMARK OFFICE

CERTIFICATE OF CORRECTION

PATENT NO. : 7,591,928 B2
APPLICATION NO. : 11/513961
DATED : September 22, 2009
INVENTOR(S) : Billings et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 315 days.

Signed and Sealed this

Twenty-first Day of September, 2010

David J. Kappos

David J. Kappos
*Director of the United States Patent and Trademark Office*